United States Patent [19]

Blackwood et al.

[11] Patent Number: 4,499,839

[45] Date of Patent: Feb. 19, 1985

[54] REVERSE FEED CONTROLLING MECHANISM FOR A SEWING MACHINE

[75] Inventors: John Blackwood, Union; Thomas G. Graham, Ocean; Robert B. Brauch, Wayne, all of N.J.

[73] Assignee: The Singer Company, Stamford, Conn.

[21] Appl. No.: 558,082

[22] Filed: Dec. 3, 1983

[51] Int. Cl.[3] ..... D05B 27/00; D05B 3/04

[52] U.S. Cl. ..... 112/317

[58] Field of Search ..... 112/317, 316

[56] References Cited

U.S. PATENT DOCUMENTS

| | | | |
|---|---|---|---|
| 1,387,140 | 8/1921 | Flanagan . | |
| 2,024,434 | 12/1935 | Eames . | |
| 3,088,427 | 5/1963 | Bruscaglioni . | |
| 3,467,040 | 9/1969 | Hacklander . | |
| 3,949,691 | 4/1976 | Adams | 112/316 |
| 4,143,608 | 3/1979 | Coulombe et al. | 112/316 |
| 4,145,983 | 3/1979 | Law et al. . | |
| 4,183,314 | 1/1980 | Sato | 112/317 X |
| 4,365,569 | 12/1982 | Adams . | |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A manually operable input control member is mounted in a sewing machine for linear movement into a reverse feed controlling position and for pivotal movement therefrom into a reverse feed sustaining position wherein the member is held against a spring which is provided to bias it toward an unactuated hands off position in the machine.

11 Claims, 8 Drawing Figures

Fig. 2.
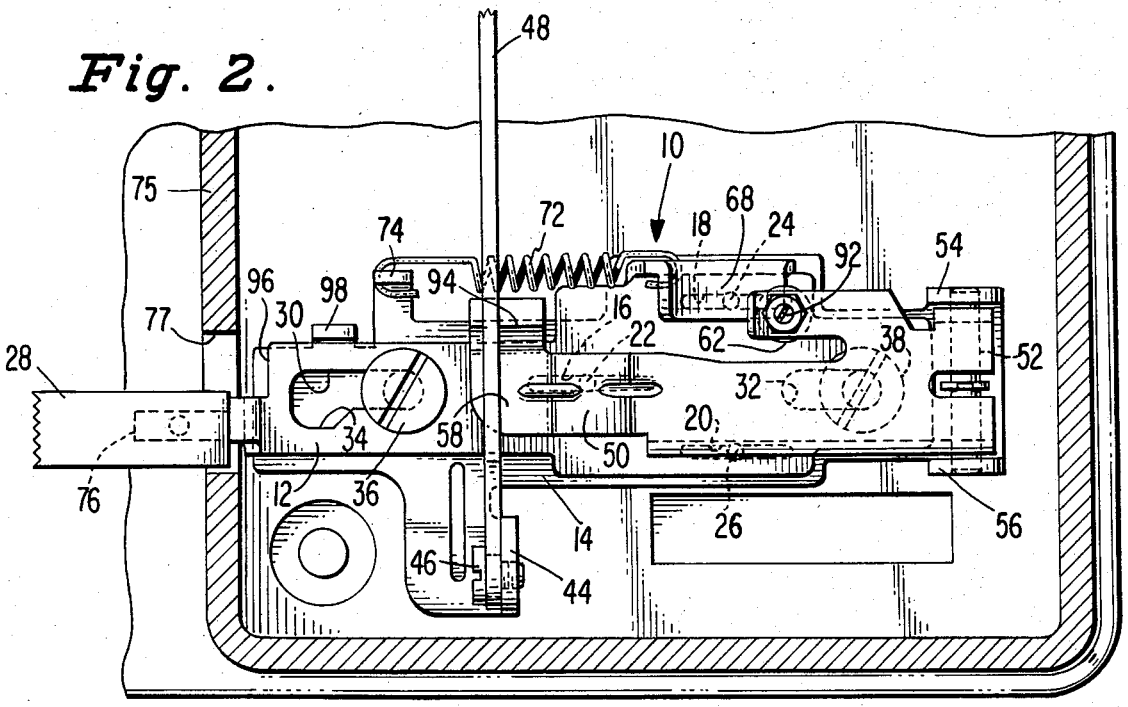
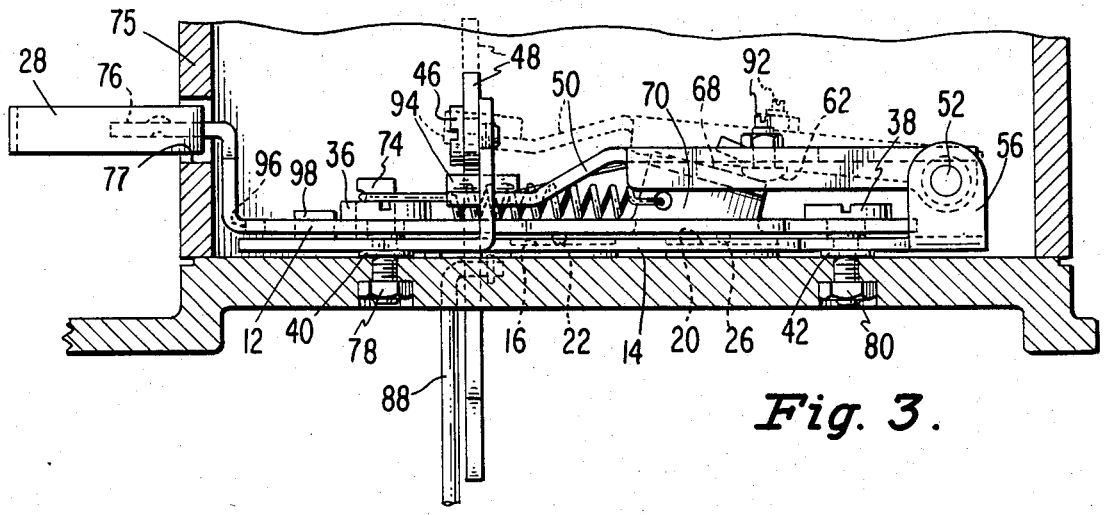
Fig. 3.
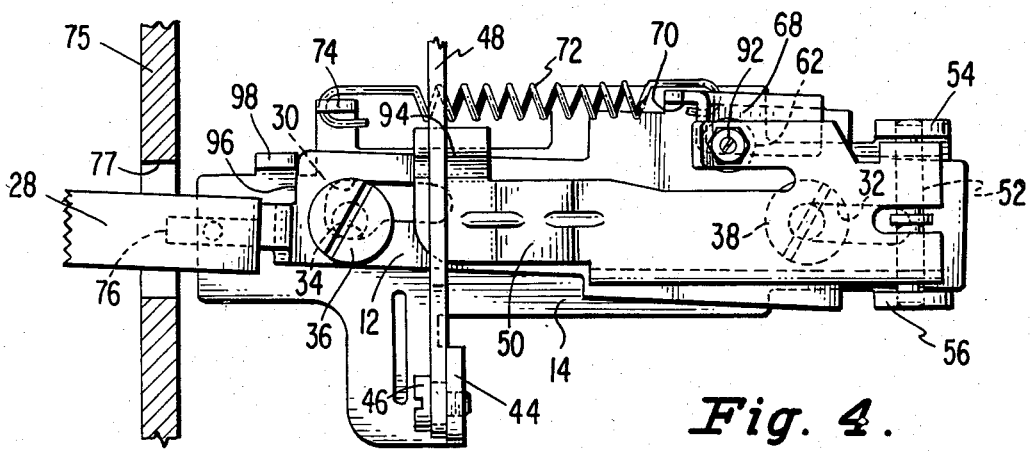
Fig. 4.

REVERSE FEED CONTROLLING MECHANISM FOR A SEWING MACHINE

DESCRIPTION

1. Background of the Invention

The invention relates to reverse feed controlling mechanism for sewing machines.

2. Description of the Prior Art

Sewing machines are commonly provided with manually operable controls with which an operator can influence the operation of feed regulating mechanism to control stitch length, or initiate a reverse feeding operation. Selectively operable cams may also be provided for use as devices to automatically influence the operation of the feed regulating mechanism and so provide for pattern stitching.

The prime object of the present invention is to provide improved reverse feed controlling mechanism including a control member which an operator can push horizontally inward on a sewing machine to effect a momentary reversal in the feeding direction, and which he or she can move therefrom to a latched position to effect a sustained reversal in the feeding direction.

It is another object of the invention to provide improved reverse feed controlling mechanism for a sewing machine including means for adjusting the response of the mechanism to the operation of a control member by a machine operator.

Other objects and advantages of the invention will become apparent during a reading of the specification taken in connection with the accompanying drawings.

SUMMARY OF THE INVENTION

Reverse feed controlling mechanism for a sewing machine is provided according to the invention with an input control member which is mounted for linear and pivotal movement by a machine operator. The said mechanism includes a pivoted member which is disposed to extend under a portion of a feed regulating lever, a ramp on one of the two said members and a foot on the other positionable along the ramp during linear movement of the control member for causing the member extending under the pivoted lever to tilt upwardly and move the lever into a reverse feed controlling position. The input control member is biased by a spring toward an unactuated hands off position, but is restrained from being so moved by holding means when in a defined linearly displaced and pivoted reverse feed selecting position.

DESCRIPTION OF THE DRAWINGS

FIG. 2 is a top plan view of the mechanism of FIG. 1;

FIG. 3 is a side elevational view of the mechanism;

FIG. 4 is a top plan view showing the mechanism in a sustained reverse feed controlling condition;

DESCRIPTION OF THE PREFERRED EMBODIMENT

Figure 1:
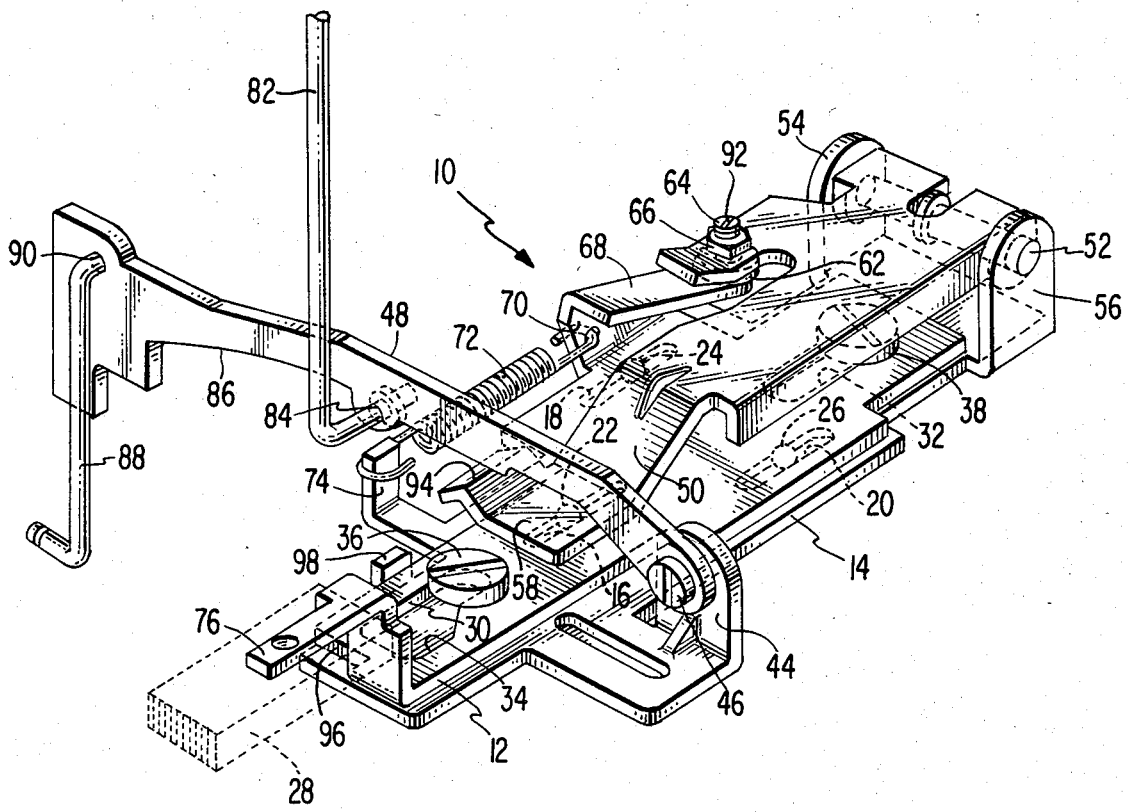
FIG. 1 is a perspective view of reverse feed controlling mechanism according to the invention for use in a sewing machine.

Referring to the drawings, reference character 10 designates reverse feed controlling mechanism according to the invention including an input control member 12 and a support 14 with grooves 16, 18 and 20 wherein ball bearings 22, 24 and 26 are located. Member 12 rests on balls 22, 24 and 26, and is movable thereon relative to support 14.

A knob 28 is affixed to the front end of the member. Member 12 includes elongate slots 30 and 32. One slot 30, which is closer to the knob supporting end of the member than the other slot, includes a widened front section 34, as shown. Shouldered screws 36 and 38 extend through slots 30 and 32, respectively, and through support 14 to which they are secured by spring fastners 40 and 42.

Support 14 includes an upright flange 44 wherein a shouldered screw 46 pivotally supports a feed regulating lever 48 extending over control member 12 in a direction substantially perpendicular thereto. A member 50 is pivotally mounted at one end on a pin 52 which is affixed in upright flanges 54 and 56 formed on support 14. An opposite end portion 58 of member 50 extends under feed regulating lever 48. Member 50 carries a shoe 62 formed at the end of a screw 64 which is threaded into the member and secured thereto with a nut 66. The weight of member 50 causes shoe 62 to bear against a ramp 68 on a bracket 70 which is formed as an integral part of member 12.

A coil spring 72, having one end connected to bracket 70 and the opposite end connected to a tang 74 on support 14 biases member 12 into an unactuated hands off position (see FIGS. 1, 2 and 3)in which screws 36 and 38 are engaged by the rear ends of slots 30 and 32, and a low end portion of ramp 68 is engaged by shoe 62.

Figure 8:
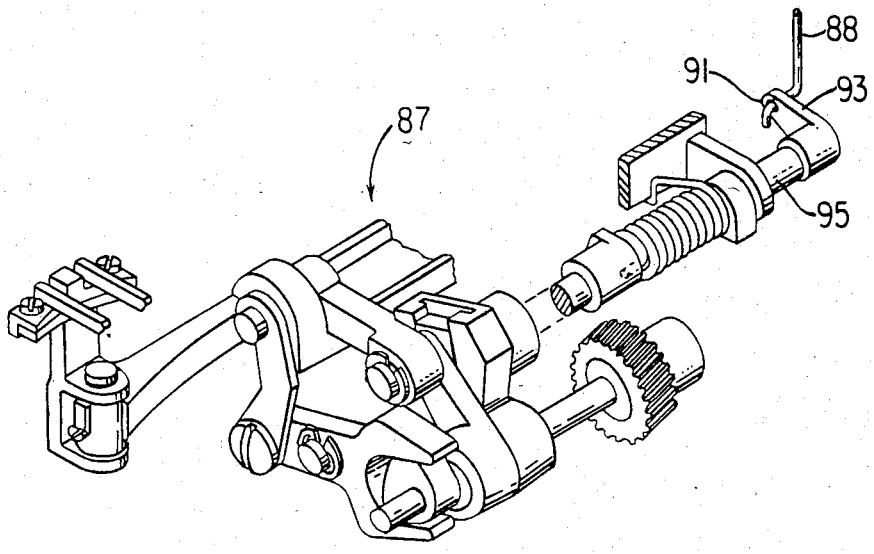
FIG. 8 is a perspective view showing feed regulator mechanism to which the reverse feed control of the invention is connected.

The reverse feed controlling mechanism 10 is mounted transversely in a sewing machine frame 75 with a knob supporting portion 76 of member 12 extending through a slot 77 in the frame, and knob 28 accessible to an operator. Nuts 78 and 80 on screws 36 and 38 mount mechanism 10 in the machine. The feed regulating lever 48 would be operably connected in the machine with manually operable stitch length control means, as for example through a cam (not shown) engageable with an under edge portion 86 of the lever 48. The feed regulating lever may also be connected as through a link 82 pivotally mounted on lever 48 a 84 with pattern control means. Lever 48 is operably connected in a known manner to a feed regulator 87 (FIG. 8) such as shown, for example, in U.S. Pat. No. 4,145,983 for "Feed Regulating Mechanism for a Sewing Machine" of Joseph P. Larr and Alfred R. Mack, issued Mar. 27, 1979 as, for example, through a link 88 pivotally connected at one end 90 to the lever 48 and at the opposite end 91 to a crank 93 affixed to the feed control rock shaft 95 of the feed regulator. While lever 48 is in a maximum stitch length prescribing position, shoe 62 is vertically adjusted with a screw driver in screw slot 92 to substantially eliminate any clearance which may then exist between an elevated edge 94 on member 50 and link 48.

Member 12 is actuated with a horizontal push inward on knob 28 effective to cause the member to move linearly on balls 22, 24 and 26 to a limiting position while guided by screws 36 and 38 in slots 30 and 32.

Figure 5:
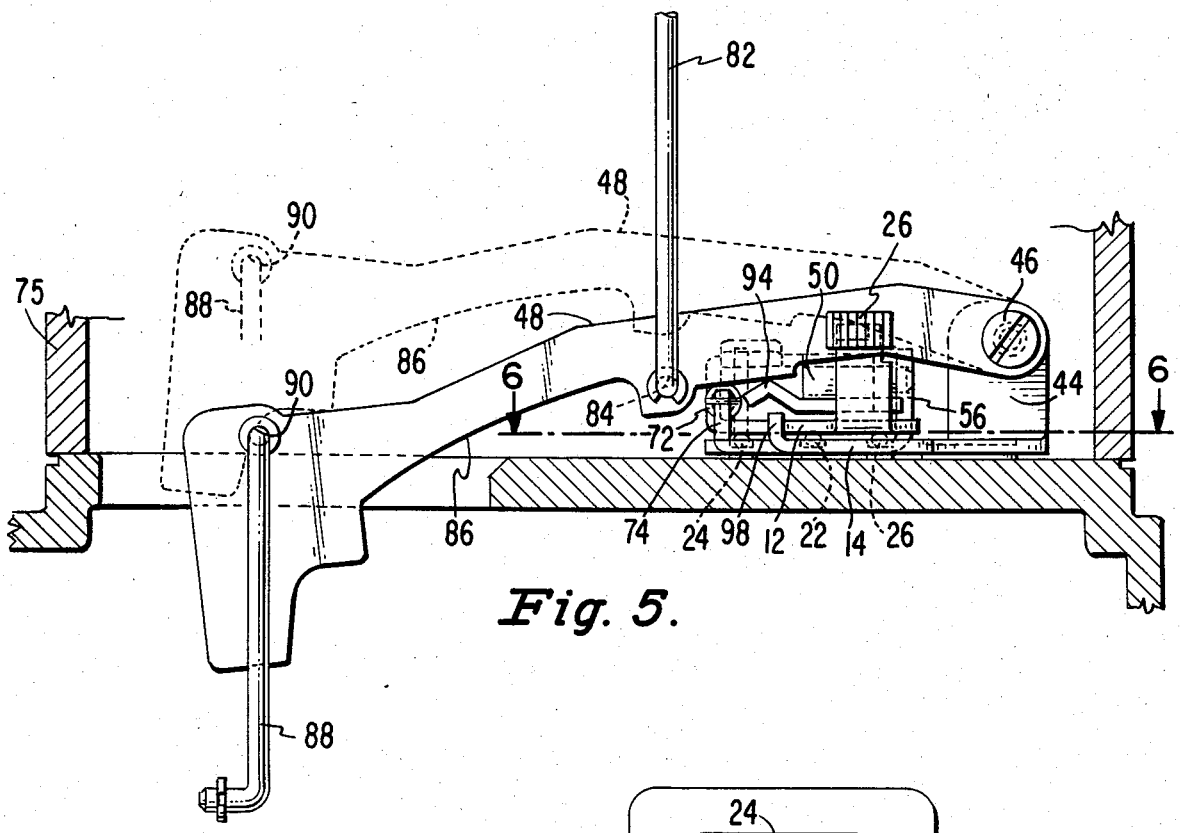
FIG. 5 is a front elevational view of said mechanism.
Figure 6:
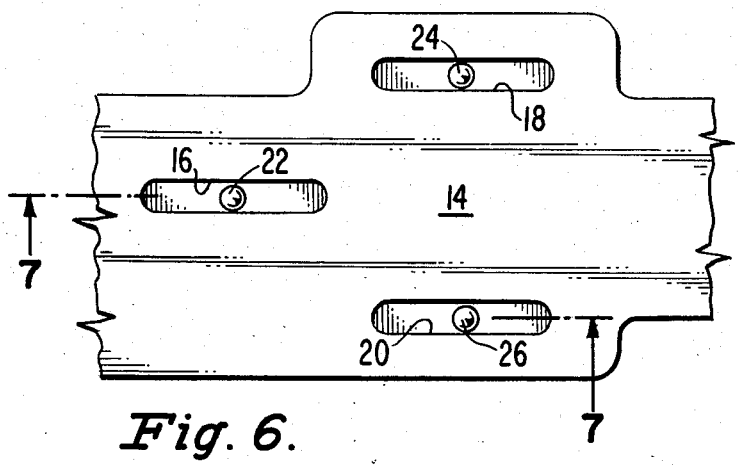
FIG. 6 is a fragmentary plan view taken on the plane of the line 6—6 of FIG. 5.
Figure 7:
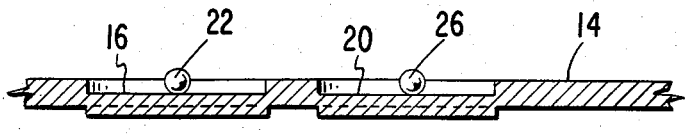
FIG. 7 is a sectional view taken on the plane of the line 7—7 of FIG. 6.

Member 12 is so moved until the rearward ends of slots 30 and 32 engage screws 36 and 38. Shoe 62 is caused to move to a maximum height on ramp 68, and member 50 is tilted upwardly about pin 52 as the shoe ascends the ramp. At the same time, lever 48 is pivoted upwardly by the member about screw 46 into a reverse feed controlling position (dashed line position in FIG. 5). If only a momentary reversal in the feeding direction, that is from forward to reverse, is desired, knob 28 is immediately released, whereupon member 12 is returned to its unactuated hands off position by spring 72. Shoe 62 then rides back down the ramp 68, and both member 50 and lever 48 return to original positions. If sustained reverse feeding is desired, member 12, after having been pushed inwardly to the limiting position, is pivoted slightly with knob 28 about screw 38 in a direction causing screw 36 to enter the widened front section 34 of slot 30, and a forward edge portion 96 of member 12 to move behind a tab 98 on support 14 (FIG. 4). When member 12 has been so disposed, tab 98 will hold member 12 in a reverse feed controlling position against the bias of spring 72 without operator assistance. Reverse feeding is discontinued by the operator pivoting member 12 out from behind tab 94 and permitting spring 72 to then return member 12 its unactuated hands off position.

The invention has been described herein in its preferred form, however, it is to be understood that the words which have been used are words of description rather than limitation and that changes within the purview of the appended claims may be made without departing from the spirit and scope of the invention.

We claim:

1. In a sewing machine, an input control member mounted for a linear and pivotal movement by a machine operator, a pivoted feed regulating lever, a pivoted member extending under a portion of the feed regulating lever, a ramp on one of the said members, and a foot on the other member positionable along the ramp during linear movement of the control member for causing the member extending under the pivoted lever to tilt upwardly and by engagement with said lever pivotally move the lever into a reverse feed controlling position.

2. The combination of claim 1 including means mounting the foot on said other member for adjustment relative to the ramp on the said one member.

3. The combination of claim 1 wherein the ramp is on the control member, and the foot is on the other member.

4. The combination of claim 1 wherein the control member and other member extend substantially perpendicular to the pivoted feed regulating lever.

5. The combination of claim 1 including spring means for biasing the input control member into an unactuated hands off position.

6. The combination of claim 5 including means engageable with the input control member in a defined linearly displaced and pivoted reverse feed selecting position of the control member for holding the control member against the bias of the spring means.

7. The combination of claim 1 including a fixed support for the control member and ball bearings between the fixed support and control member, the control member being linearly and pivotably movable on said ball bearings.

8. The combination of claim 7 with grooves in the fixed support and the ball bearings located therein.

9. The combination of claim 1 including a fixed support for the control member, the control member being formed with an elongated slot and the fixed support having guide means thereon extending through the elongated slot in the control member for defining the linearly movement of the control member, the slot being enlarged at one end to permit pivotal movement of the control member into the position wherein it is held against the bias of the spring means.

10. The combination of claim 9 wherein said member extending under a portion of the feed regulating lever is mounted on the fixed support.

11. The combination of claim 10 wherein the feed regulating lever is also mounted on the fixed support.

* * * * *